US008522405B2

(12) United States Patent
Spielberger

(10) Patent No.: US 8,522,405 B2
(45) Date of Patent: Sep. 3, 2013

(54) BELT BUCKLE

(76) Inventor: Peter Spielberger, Vienna (AT)

( * ) Notice: Subject to any disclaimer, the term of this patent is extended or adjusted under 35 U.S.C. 154(b) by 0 days.

(21) Appl. No.: 12/927,147

(22) Filed: Nov. 8, 2010

(65) Prior Publication Data

US 2011/0107562 A1 May 12, 2011

(51) Int. Cl.
*A44B 11/22* (2006.01)

(52) U.S. Cl.
USPC ..... 24/186; 24/163 R; 24/169; 24/176; 24/177; 24/198; 2/311; 2/312; 2/322

(58) Field of Classification Search
USPC ..... 24/163 R, 169, 176, 177, 186, 198; 2/311, 312, 321, 322
See application file for complete search history.

(56) References Cited

U.S. PATENT DOCUMENTS

| | | | | | |
|---|---|---|---|---|---|
| 316,872 | A | * | 4/1885 | Bretzfiel | 24/164 |
| 370,757 | A | * | 10/1887 | Banks | 54/54 |
| 2,173,442 | A | * | 9/1939 | Ream | 54/21 |
| 2,419,662 | A | * | 4/1947 | Sutton | 24/186 |
| 3,155,987 | A | * | 11/1964 | McGill | 2/322 |
| 3,913,147 | A | * | 10/1975 | Ostrander | 2/325 |
| 4,876,771 | A | * | 10/1989 | Givati | 24/298 |
| 5,127,136 | A | * | 7/1992 | Magnus | 24/176 |
| 5,732,448 | A | * | 3/1998 | Shields et al. | 24/180 |
| 5,802,681 | A | * | 9/1998 | Riley et al. | 24/326 |
| 6,343,384 | B1 | * | 2/2002 | Ida | 2/236 |
| 6,412,148 | B1 | * | 7/2002 | Morris | 24/176 |

FOREIGN PATENT DOCUMENTS

| | | |
|---|---|---|
| SU | 1489706 A1 | 6/1989 |
| WO | PCT/US2004/044059 | 12/2004 |

* cited by examiner

*Primary Examiner* — Robert J Sandy
*Assistant Examiner* — David Upchurch
(74) *Attorney, Agent, or Firm* — Bennet K. Langlotz; Langlotz Patent & Trademark Works, Inc.

(57) ABSTRACT

A belt buckle is provided with a waist belt outlet slot (1) for connecting with a waist belt beginning (6) and at least one inlet retainer (5) engaging in openings of the belt at the opposite waist belt inlet slot (2).
As a result of the design of the central section of the belt buckle as an essentially flat element (3), which permits deflection toward the waist belt, which reaches in the section of the, or of each inlet retainer (5) at least their height, can, in spite of a simple design, prevent an opening that is against the will of the carrier.

14 Claims, 2 Drawing Sheets

Figure 4:
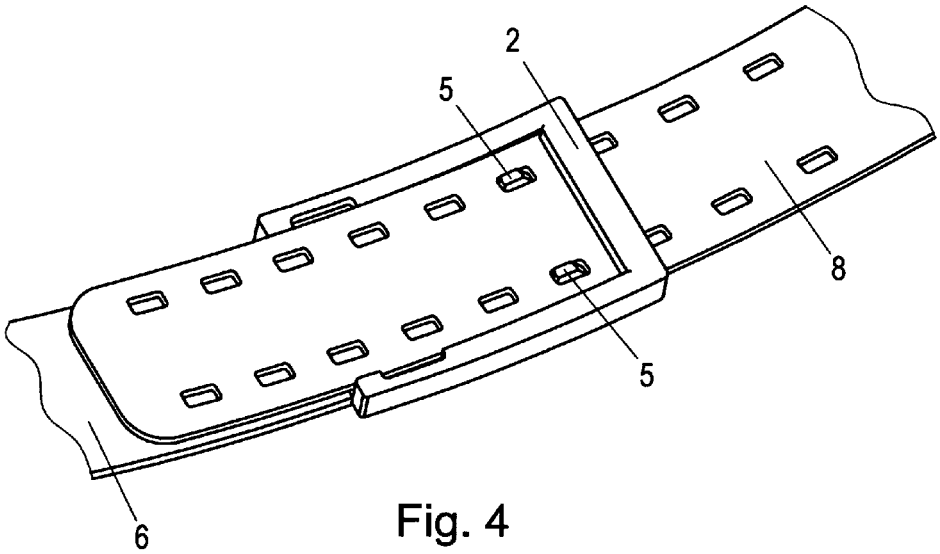

Fig. 1
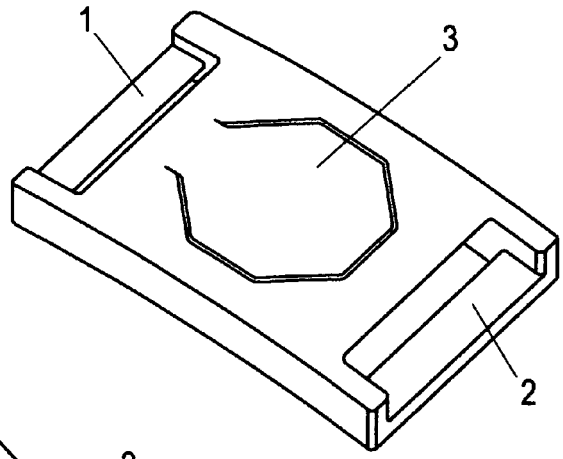
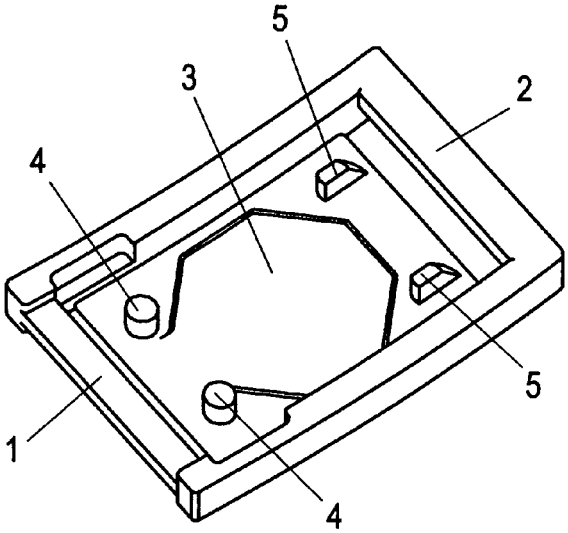
Fig. 2
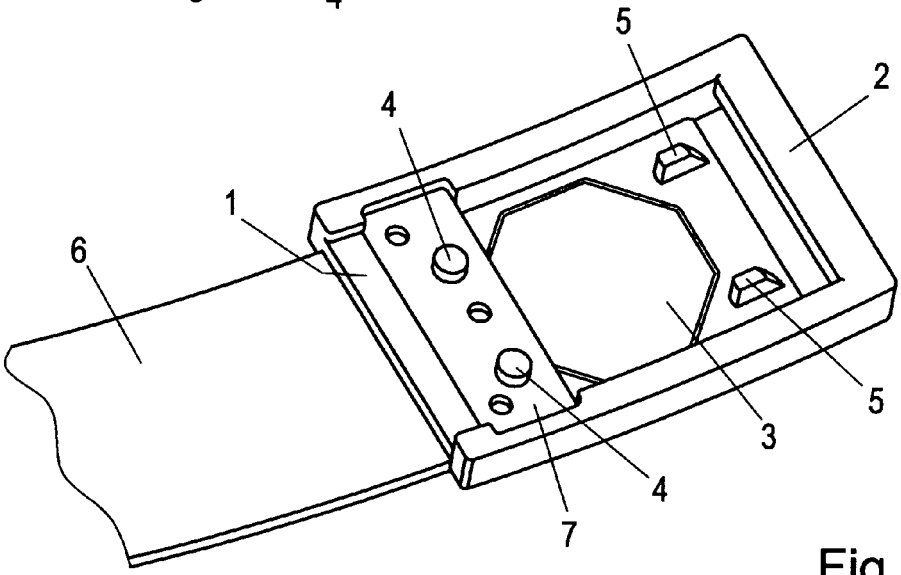
Fig. 3

BELT BUCKLE

The invention relates to a belt buckle with a belt outlet slot for connecting with a belt beginning and at least one inlet slot retainer engaging with openings in the belt at the opposite waist belt inlet slot.

The security sector and government agencies require, in particular of so-called deployment waist belts, a waist belt buckle or belt closure, which cannot be opened by potential attackers. Conventionally, belts are used that are fastened at the waist belt buckle by using hook-and-pile-fasteners that are fastened at the inner side of the waist belt. The reason for this is that at the waist belt, an immense number of containers must be attached, so that no space is available for a protruding end of the waist belt, such as is present in conventional waist belts for pants. The typically used mechanism of the waist belt buckle comprises at least two plastic parts, that are positively geared with each other in closed condition and that are provided with more than two pressure points that must be pressed for opening. An adjustment of the waist belt size due to the use of clothing depending on the season, or in deployment when using tactical and bullet-proof vests, is problematic and time-consuming, as most of the time first many or all containers must be removed from the belt and then the belt must be pulled out of the waist belt buckle. Moreover, the retention force of hook-and-pile-fasteners is very limited.

From WO2006/073387 A1, a safety waist belt buckle is known that also considers the magnitude of the problem discussed above, and which works without any hook-and-pile closures. Hereby, the arched hooks engage through elongated holes in the waist belt with a retention plate that is located underneath, which in turn is provided with an additional retention element in the form of a bolt extending in the opposite direction, as otherwise, safety would not be given. Hereby, the waist belt buckle with its hook must consist of metal, as these could otherwise not absorb the forces that are present. In addition, the counter piece must still be shimmed with leather, in order to prevent damage to clothing or an injury of the carrier.

The objective of the present invention therefore was a belt buckle that does not allow opening against the will of the carrier and is still simply designed and permits the adjustment of the belt or waist belt, without the necessity of having to make modifications at the belt.

To solve this problem, the belt closure in accordance with the invention is characterized thereby, that the central section of the belt closure is formed by an essentially flat element, which permits a deflection toward the belt, which attains—in the section of the, or of each inlet retainer—at least their height. In addition to the advantage, that this design cannot be opened by potential attackers, the belt closure has a very simply and functionally secure design, preferably consisting of one piece. A further advantage lies therein, that the length of the belt that is used can vary widely and the length that projects beyond the belt buckle, i.e. the excess length, does not represent any type of conflict with the pieces of equipment that are threaded on the belt.

According to an advantageous embodiment it is provided that the element on which the side opposite to the—or to every inlet retainer is attached elastically deflectable.

Preferably, the element can be designed entirely as elastically deflectable spring element.

In the following description, the invention will be explained in more detail in conjunction with the enclosed drawings.

Figure 5:
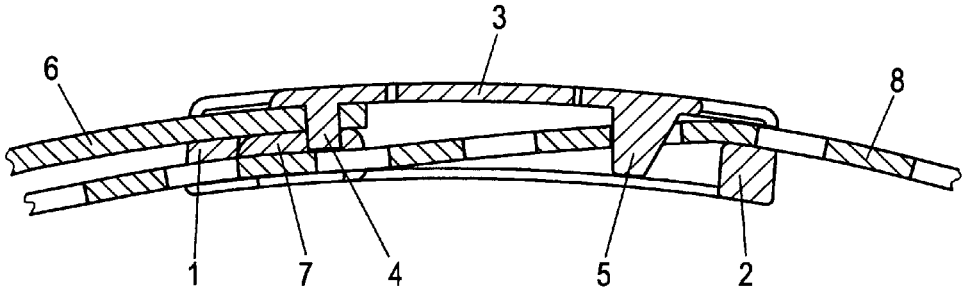

Thereby, FIG. 1 shows a view of an embodiment of the belt buckle in accordance with the invention from the outside, FIG. 2 is a view from the interior, FIG. 3 shows a view corresponding to that in FIG. 2 with inserted waist belt, FIG. 4 is a view corresponding to FIG. 2 with inserted waist belt and in a condition connected with the waist belt end, and FIG. 5 is a longitudinal cross section along the belt of FIG. 4.

As can be seen in FIG. 1, the belt closure preferably consists of only a single part, which has a belt outlet slot 1 for connecting with a belt beginning 6 (see FIG. 3) and a belt inlet slot 2 that is opposite in the longitudinal direction of the waist belt. In the central section of the belt buckle, an essentially flat element 3 is provided, which allows a deflection toward the waist belt. On the side facing the carrier, which can be seen in FIG. 2, in the section of the belt outlet slot 1, there are outlet retainers 4 for connecting the belt buckle with the belt beginning 6 that is put over the outlet retainers 4, which thus prevents a sliding out through the belt outlet slot 1. At the waist belt beginning 6, an outlet plate 7 can additionally be attached, preferably by rivets, which can have advantages for production, and beyond that, can additionally positively influence the force intake and force transfer to the waist belt buckle. But the waist belt beginning 6 could also be fastened at the waist belt outlet slot 1 by sewing, riveting, adhesion or the like.

The end of the waist belt 8, as shown in FIG. 4, is guided through the waist belt inlet slot 2, where corresponding to the pattern of holes in the belt, inlet retainers 5 are provided that engage with the openings of the waist belt and thus accomplish the locking of the waist belt. The belt inlet slot 2 is designed in such a way that a hinging away of the waist belt buckle, as it can sometimes happen in conventional belt buckles, is made impossible. The shape of the inlet retainer 5 makes it possible to simply slide the waist belt end 8 over it, but it prevents the simple pulling out in the opposite direction, as the waist belt end 8, due to the geometric configuration (see FIG. 5) would only push more onto the inlet retainers 5 that engage with the openings—preferably designed as elongated holes—in the waist belt. The excess length of the waist belt end 8 hides, and is invisible even for a potential attacker and cannot be grasped under the waist belt beginning 6, which is advantageous during disturbances and in combat situations. This also does not impair the attachment of pieces of equipment to the waist belt beginning 6.

The essentially flat element 3 that is preferably provided in the central section of the belt buckle, which if need be, can also be designed as a separate component that is mounted elastically deflectable, permits a deflection toward the waist belt or in the direction of the carrier, which reaches at least in the section of the, or of each inlet retainer 5, at least their height. In order to open the waist belt, the carrier must encompass the belt buckle in such a way that he can push element 3 inward toward the body of the carrier. For an attacker, the number of movements that would have to be performed would not be possible. Element 3 can, in the course of this deflection, push the waist belt end 8 off the inlet retainers 5, and while maintaining pressure on element 3, the waist belt end 8 can then be pulled out of the belt inlet slot 2.

The invention claimed is:

1. A belt with closure comprising:

a closure body;

an elongated belt having a first end connected to the closure body and a second free end operable for removable connection to the closure body;

the belt defining a plurality of belt holes proximate the free end;

the closure body defining an inlet slot for receiving the free end of the belt;

the closure body comprising a frame and a retention element attached to the frame;

the retention element being fixed to the frame, such that the retention element does not move with respect to the frame;

the retention element being sized to occupy a corresponding one of the belt holes when the free end is inserted into the inlet slot; and the closure body having a release element operable to move between a retention position and a releasing position, and whereby moving the release element to the releasing position deflects a portion of the free end of the belt to disengage the hole from the retention element, enabling extraction of the free end from the closure body.

2. The belt of claim 1 wherein the retention element has an angled surface facing the inlet slot such that insertion of the free end is facilitated by the free end guiding over the retention element by way of deflection by the angled surface.

3. The belt of claim 1 wherein the retention element has a retention surface facing away from the inlet slot, such that extraction of the free end is prevented by a portion of the belt hole periphery bearing on the retention surface.

4. The belt of claim 3 wherein the closure body is a planar body and the retention surface is substantially perpendicular to the retention element.

5. The belt of claim 1 wherein the free end is concealed beneath the first end when the belt is worn when viewed from in front of the closure body.

6. The belt of claim 1 wherein each belt hole is a rectangular aperture.

7. The belt of claim 1 wherein the closure body has a planar front panel, and wherein the release element is a portion of the front panel defined by a peripheral gap separating the release element from the remainder of the front panel, except at a peripheral connection on one end of the release element.

8. The belt of claim 1 wherein the release element operates as a leaf spring, with one end connected to the closure body, and a free end operable to contact the free end of the belt.

9. The belt of claim 8 wherein the free end of the release element extends toward the inlet slot.

10. The belt of claim 9 wherein the free end of the release element is proximate the retention elements.

11. The belt of claim 1 wherein the retention element has a planar front panel, and wherein the release element is a portion of the front panel having a periphery, and wherein the majority of the periphery is defined by a gap separating the release element from the retention element.

12. The belt of claim 1 wherein the retention element captures both the first end and the free end of the belt when the belt is worn.

13. The belt of claim 1 wherein the retention element retains the free end of the belt and prevents the free end of the belt from exiting the inlet slot when free end of the belt is pulled outward away from the wearer when the belt is worn.

14. The belt of claim 1 wherein the retention element is integrally formed with the frame.

* * * * *